US005826804A

United States Patent [19]

Reiter et al.

[11] Patent Number: 5,826,804

[45] Date of Patent: Oct. 27, 1998

[54] DEVICE FOR THE INJECTION OF A FUEL/ GAS MIXTURE

[75] Inventors: Ferdinand Reiter, Markgroeningen; Heinz-Martin Krause, Ditzingen; Juergen Buchholz, Lauffen; Roland Beilhardt, Korntal-Muenchingen, all of Germany

[73] Assignee: Robert Bosch GmbH, Stuttgart, Germany

[21] Appl. No.: 599,836

[22] Filed: Feb. 12, 1996

[30] Foreign Application Priority Data

Feb. 21, 1995 [DE] Germany ..... 195 05 886.0

[51] Int. Cl.[6] ..... B05B 1/30; F02M 51/00

[52] U.S. Cl. ..... 239/585.1; 239/900; 239/417.3; 239/596

[58] Field of Search ..... 239/585.1, 585.3, 239/585.4, 585.5, 900, 533.9, 533.12, 408, 417.3, 596

[56] References Cited

U.S. PATENT DOCUMENTS

| | | | |
|---|---|---|---|
| 4,519,370 | 5/1985 | Iwata | 239/533.12 X |
| 4,566,634 | 1/1986 | Wiegand | 239/533.12 X |
| 5,035,358 | 7/1991 | Katsuno et al. | 239/900 X |
| 5,193,743 | 3/1993 | Romann et al. | 239/585.5 X |
| 5,197,672 | 3/1993 | Grytz et al. | 239/585.5 X |
| 5,207,383 | 5/1993 | Hans et al. | 239/533.12 X |
| 5,395,050 | 3/1995 | Nowak et al. | 239/585.4 X |
| 5,437,413 | 8/1995 | Shen et al. | 239/585.4 X |
| 5,540,387 | 7/1996 | Reiter et al. | 239/585.1 X |

FOREIGN PATENT DOCUMENTS

| | | | |
|---|---|---|---|
| 41 21 372 | 12/1992 | Germany . | |
| 43 12 756 | 10/1994 | Germany . | |
| 4209154 | 9/1992 | Japan | 239/900 |
| 92/14052 | 8/1992 | WIPO . | |
| 95/17595 | 6/1995 | WIPO . | |

*Primary Examiner*—Lesley D. Morris
*Attorney, Agent, or Firm*—Kenyon & Kenyon

[57] ABSTRACT

A device for the injection of a fuel/gas mixture is particularly simple and cost-effective for gas containment of fuel emerging from an injection valve. For this purpose, a treatment attachment is provided at the downstream end of the injection valve, the treatment attachment including at least a gas containment part and an insert body which are fixedly connected to one another. The treatment attachment is fixedly connected to the injection valve by means of a casing portion of the bowl-shaped gas containment part, while a bottom portion of the gas containment part has material of the insert body at least partially injection-molded around it. Inside the insert body extends an orifice which at least partially widens conically in the downstream direction and in which, for example, a jet divider is arranged. The device is particularly suitable for injection into the suction pipe of a mixture-compressing spark-ignition internal combustion engine.

28 Claims, 5 Drawing Sheets

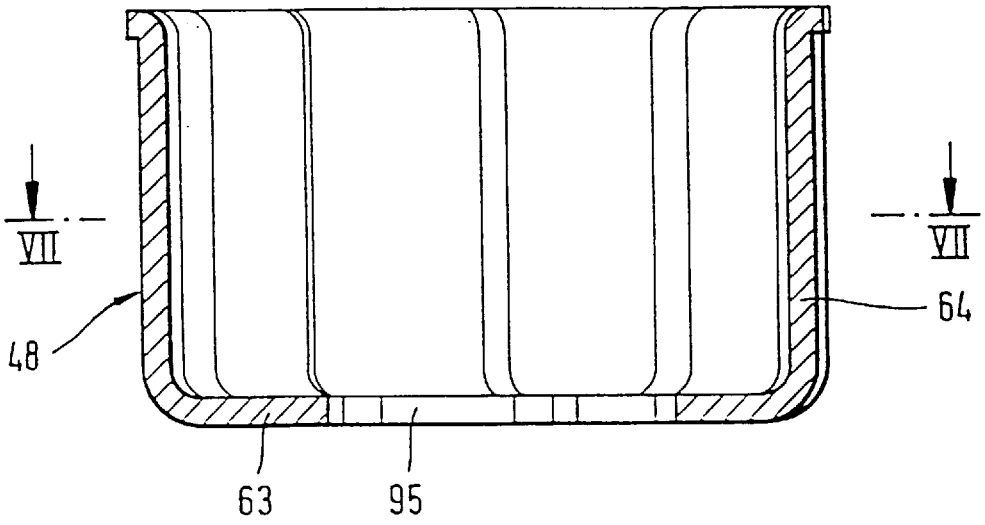
FIG. 6
FIG. 7
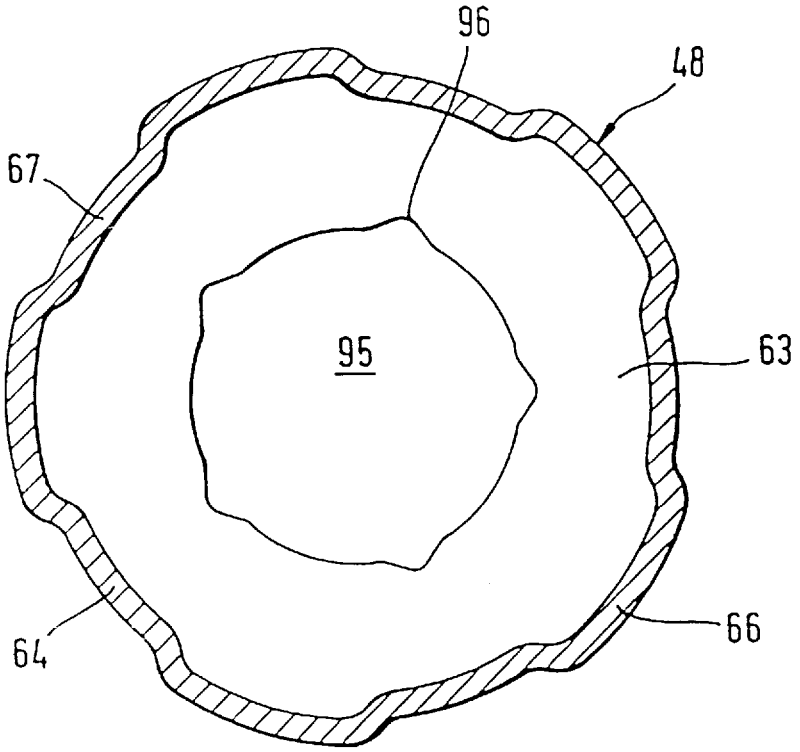

DEVICE FOR THE INJECTION OF A FUEL/GAS MIXTURE

BACKGROUND INFORMATION

An electromagnetically actuable valve for the injection of a fuel/gas mixture into a mixture-compressing spark-ignition internal combustion engine is described in German Patent Application No. 41 21 372. A gas containment sleeve surrounds a nozzle body of a fuel injection valve. In this case, the gas containment sleeve is designed in such a way that its bottom part is shaped with a concentric passage orifice obliquely towards the valve end of the fuel injection valve. An annular gas gap is thereby formed between a perforated injection disk and the bottom part of the gas containment sleeve. The gas stream emerging from the annular gas gap is directed radially onto the individual fuel jets emerging from the perforated injection disk and causes the fuel jets to approach one another to the point of possible unification to form a single fuel jet.

Moreover, German Patent Application No. 43 12 756 describes a device for the injection of a fuel/gas mixture, a gas containment body being designed in such a way that it presses a sheet metal insertion part having spacer bodies, for example knobs, against a perforated injection disk and clamps it between itself and the perforated injection disk. By means of the specially shaped sheet metal insertion part and the knobs formed in a dimensionally accurate manner, as well as the annular gas gap resulting from this in its axial extension, the metering of the gas takes place for the purpose of the improved treatment of the fuel. A differential cone angle formed between the sheet metal insertion part and the gas containment body guarantees axial tolerance compensation with respect to the sheet metal insertion part and to the gas containment body in relation to the perforated injection disk.

SUMMARY OF THE INVENTION

An advantage of the device according to the present invention for the injection of a fuel/gas mixture is that gas containment of fuel emerging from an injection valve is obtained simply, cost-effectively and at a low outlay in terms of assembly. This is achieved in that a treatment attachment is arranged at the downstream end of the injection valve, the treatment attachment including at least a gas containment part and an insert body which are connected fixedly to one another and which allow functional separation in a simple way. The tool cost for producing the treatment attachment can be kept very low on account of the simple design.

It is particularly advantageous to design the treatment attachment as a composite metal/plastic part so that any shapes of injection spaces (treatment geometry) in the insert body can be produced in a simple way by injection molding. Only the, for example, bowl-shaped gas containment part then serves for fastening the treatment attachment to the injection valve. This fastening advantageously takes place by means of welding. A casing portion of the gas containment part is designed in the circumferential direction with alternating regions of larger and smaller diameter, the regions of smaller diameter bearing on the injection valve, so that the connection of the gas containment part to the injection valve can be made there, while the regions of larger diameter afford possibilities for the gas to flow in towards the fuel. It is advantageous if the bottom portion of the bowl-shaped gas containment part has the material of the insert body at least partially injection-molded around it, so that a fixed connection of the gas containment part and insert body is provided.

If it is desirable, despite the gas containment, to maintain a multi-jet feature of the injection valve predetermined by the injection orifices, then it is particularly expedient to arrange a jet divider in the injection space of the insert body. It is particularly advantageous to use jet dividers with convex divider surfaces which have circular, semicircular or elliptic cross sections. The convex jet divider acts as flow resistance, thereby inducing a stagnation flow. The stagnation flow is responsible for the multi-jet feature being maintained, despite gas containment, even downstream of the jet divider, and for the good treatment effect of the gas containment as a result of an improved intermixing of gas and fuel.

BRIEF DESCRIPTION OF THE DRAWINGS

FIG. 6 shows a gas containment part as part of a treatment attachment according to the present invention.

FIG. 7 shows a section along the line VII—VII in FIG. 6.

DETAILED DESCRIPTION

Figure 1:
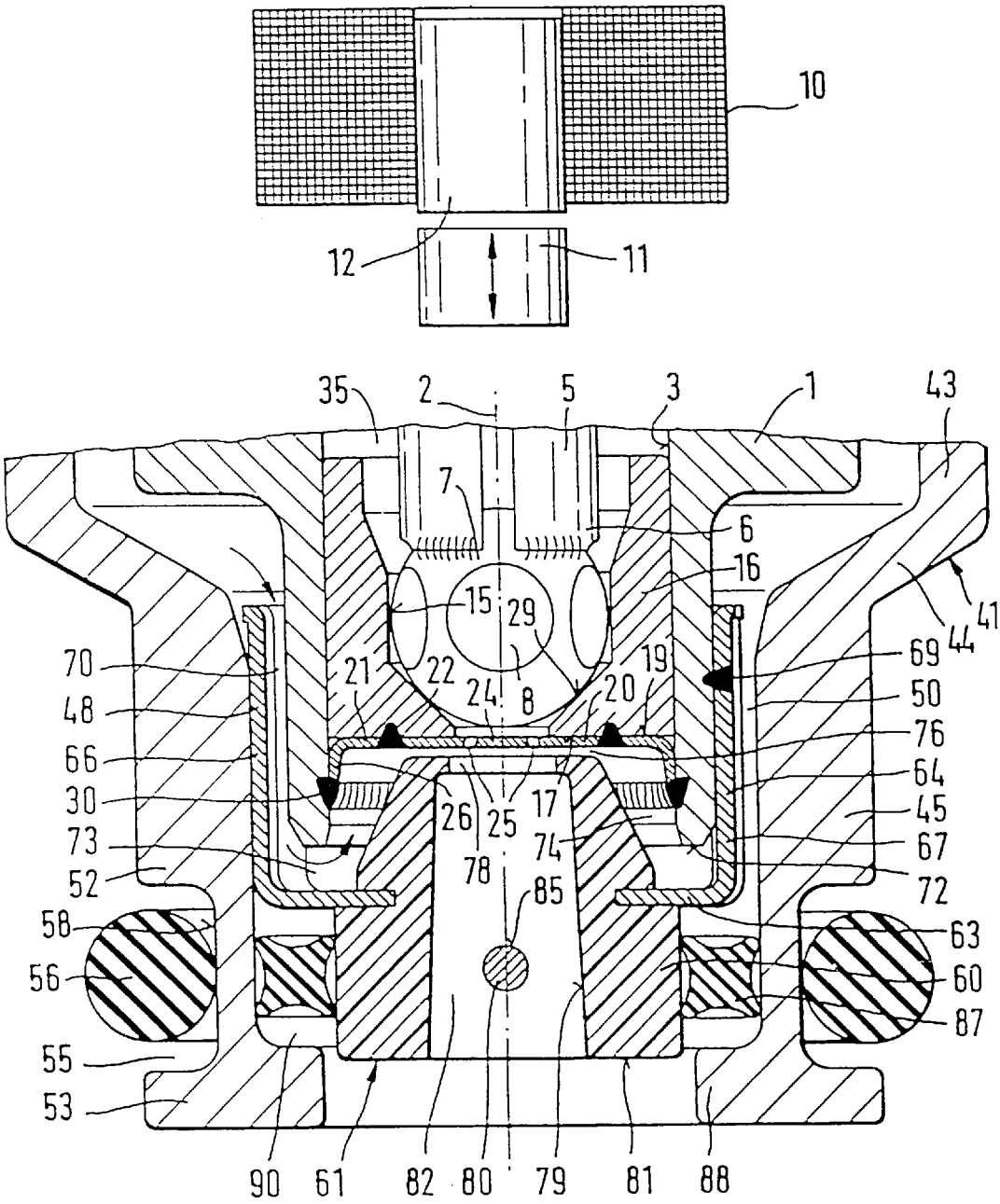
FIG. 1 shows a partially represented device for the injection of a fuel/gas mixture in a first exemplary embodiment according to the present invention.

A valve in the form of an injection valve for fuel injection systems of mixture-compressing spark-ignition internal combustion engines is represented partially and in simplified form as an exemplary embodiment in FIG. 1. The injection valve has a tubular valve seat carrier 1, in which a longitudinal orifice 3 is formed concentrically to a valve longitudinal axis 2. Arranged in the longitudinal orifice 3 is a, for example, tubular valve needle 5 which is connected at its down-stream end 6 to a, for example, spherical valve closing body 7, on the circumference of which, for example, five flattenings 8 are provided.

The actuation of the injection valve takes place in a known way, for example electromagnetically. For the axial movement of the valve needle 5 and therefore for opening counter to the spring force of a return spring (not shown) or for closing the injection valve, there is an indicated electromagnetic circuit with a magnet coil 10, an armature 11 and a core 12. The armature 11 is connected, for example, by means of a weld seam, by means of a laser to that end of the valve needle 5 facing away from the valve closing body 7 and is aligned with the core 12. The magnet coil 10 surrounds the core 12 which, for example, constitutes the end, surrounding the magnet coil 10, of an inlet connection piece, not shown in more detail, which serves for supplying the medium, here fuel, to be metered by means of the valve.

A guide orifice 15 of a valve seat body 16 serves for guiding the valve closing body 7 during the axial movement. The cylindrical valve seat body 16 is sealingly fitted into the downstream end of the valve seat carrier 1, the end facing away from the core, in the longitudinal orifice 3 extending concentrically relative to the valve longitudinal axis 2. The circumference of the valve seat body 16 has a slightly smaller diameter than the longitudinal orifice 3 of the valve seat carrier 1. On one end face, its lower end face 17 facing away from the valve closing body 7, the valve seat body 16 is concentrically and fixedly connected to a bottom part 20 of a, for example, pot-shaped perforated injection disk 21, so that the bottom part 20 bears with its upper end face 19 on the lower end face 17 of the valve seat body 16. The connection of the valve seat body 16 and perforated injection disk 21 is made, for example, by a continuous and sealing first weld seam 22, for example formed by means of a laser, on the bottom part 20. This type of fitting avoids the risk of undesirable deformation of the bottom part 20 in the region of its at least two, for example four, injection orifices 25 which are formed by punching or erosion and which are located in a central region 24 of the bottom part 20.

There adjoins the bottom part 20 of the pot-shaped perforated injection disk 21 a continuous holding edge 26 which extends away from the valve seat body 16 in the axial direction and which is bent conically outwards towards its downstream end. At the same time, the holding edge 26 exerts a radial spring effect on the wall of the longitudinal orifice 3. This avoids the formation of chips on the valve seat part and on the longitudinal orifice 3 when the valve seat part including the valve seat body 16 and perforated injection disk 21 is pushed into the longitudinal orifice 3 of the valve seat carrier 1. At its free end, the holding edge 26 of the perforated injection disk 21 is connected to the valve seat carrier 1, for example by means of a continuous and sealing second weld seam 30.

The push-in depth of the valve seat part including the vale seat body 16 and pot-shaped perforated injection disk 21 into the longitudinal orifice 3 determines the size of the stroke of the valve needle 5, since one end position of the valve needle 5 is fixed, with the magnet coil 10 not energized, by the bearing of the valve closing body 7 on a valve seat face 29 of the valve seat body 16. The other end position of the valve needle 5 is fixed, with the magnet coil 10 energized, for example by the bearing of the armature 11 on the core 12. The distance between these two end positions of the valve needle 5 thus constitutes the stroke.

The spherical valve closing body 7 cooperates with the valve seat face 29 of the valve seat body 16, the valve seat face narrowing frustoconically in the direction of flow and being formed in the axial direction between the guide orifice 15 and the lower end face 17 of the valve seat body 16. The, for example, five circular flattenings 8 made on the circumference of the valve closing body 7 allow the medium to flow through, in the opened state of the injection valve, from a valve interior 35 as far as the injection orifices 25 of the perforated injection disk 21. For the exact guidance of the valve closing body 7 and therefore of the valve needle 5 during the axial movement, the diameter of the guide orifice 15 is designed in such a way that the spherical valve closing body 7 projects, outside its flattenings 8, through the guide orifice 15 with a slight radial clearance.

At its downstream end, the injection valve and therefore the valve seat carrier 1 are at least partially surrounded radially and axially by a stepped concentric gas containment body 41. The gas containment body 41 made from a plastic includes, for example, both the actual gas containment of the downstream end of the valve seat carrier 1 and a gas inlet duct (not shown) which serves for supplying the gas into the gas containment body 41 and which is made, for example, in one part with the gas containment body 41. An axially extending tubular portion 43 of the gas containment body 41, which is connected by ultrasonic welding, for example to a plastic molding injected around the injection valve, axially, between the magnet coil 10 and the valve closing body 7, has adjoining it a portion 44 which narrows conically downstream. The design of the gas containment body 41 in this region can be varied according to the conditions of space of a valve receptacle (not shown). The portion 44 is, in turn, followed downstream by an axially extending tubular portion 45 of the gas containment body 41, although the portion 45 is distinguished by a smaller diameter than the portion 43. The axial portion 45 surrounds the downstream end of the valve seat carrier 1 throughout with a radial clearance, in order to receive a bowl-shaped gas containment part 48 in an interspace 50 formed between the gas containment body 41 and the valve seat carrier 1 and connected directly to the gas inlet duct and thus to guarantee the supply of gas as far as the fuel emerging from the injection orifices 25 of the perforated injection disk 21.

The axially extending portion 45 has, at its downstream end, an annular groove 55 which is obtained by a reduction in wall thickness in the gas containment body 41. A sealing ring 56 is arranged in the annular groove 55, the side faces of which are formed by the downstream side of a shoulder 52 and the upstream side of a shoulder 53, and the groove bottom 58 of which is formed by the outer wall of the portion 45 of the gas containment body 41. The sealing ring 56 serves for sealing off between the circumference of the injection valve together with the gas containment body 41 and a valve receptacle (not shown), for example the intake conduit of the internal combustion engine or a so-called fuel and/or gas distributor conduit. While the upstream side of the shoulder 53 limits the annular groove 55, the downstream side of the shoulder 53 forms the downstream termination of the gas containment body 41.

Together with an insert body 60 made from plastic, the bowl-shaped gas containment part 48 forms, as a sheet metal part, a treatment attachment 61 completely enclosed in the axial direction by the gas containment body 41 and particularly by the axial portion 45. The insert body 60 according to the present invention, which is distinguished mainly by a largely conical or frustoconical-like shape and which is made from a plastic, extends completely downstream of the bottom part 20 of the perforated injection disk 21. In contrast, the gas containment part 48 connected fixedly to the insert body 60 is designed in such a way that a bottom portion 63 has material of the insert body 60 at least partially injection-molded around it and projects centrally from the insert body 60 radially, for example as seen over the axial length of the insert body 60. The bottom portion 63 has adjoining it a cylindrical, axially extending casing portion 64 which in the upstream direction surrounds the valve seat carrier 1, for example as far as the height of the sphere equator or of the flattenings 8 of the valve closing body 7. The casing portion 64 of the gas containment part 48 extends in the interspace 50 formed between the gas containment body 41 and the valve seat carrier 1 and, by virtue of its constructive design, guarantees a specific supply of gas.

The shape of the gas containment part 48 becomes particularly clear in FIGS. 6 and 7 and is then also described in more detail with reference to these Figures. The casing portion 64 is not made completely cylindrical, in as much as it has, for example, five regions 66 of larger diameter and five regions 67 of smaller diameter which in each case alternate in the circumferential direction of the casing portion 64. In the installed state of the gas containment part 48, the situation is then such that the annular interspace 50 is utilized in its entire radial width, since the regions 67 of smaller diameter bear on the valve seat carrier 1 and are fixedly connected to this, for example by means of weld seams 69, while the regions 66 of larger diameter extend with play along the inner wall of the portion 45 of the gas containment body 41.

Between the valve seat carrier 1 and the regions 66 of larger diameter of the casing portion 64, the same number of gas inlet ducts 70 as the number of these regions 66, that is to say, for example, five, are formed and extend axially in an arrangement at equal intervals in the circumferential direction around the valve seat carrier 1. The arrows in FIG. 1 illustrate the direction of flow of the gas. The bottom portion 63 of the gas containment part 48 extends with an axial clearance relative to a downstream end face 72 of the valve seat carrier 1, so that an annular, radially extending flow duct 73 is obtained between the bottom portion 63 and the end face 72, the flow duct adjoining the gas inlet ducts 70 and having the gas flowing radially through it. The gas thereafter flows essentially axially upstream into an annular duct 74 between the insert body 60, having an outer contour conical upstream of the bottom portion 63 and narrowing towards the perforated injection disk 21, and the wall of the longitudinal orifice 3 in the valve seat carrier 1, until the flow is deflected in the radial direction on the bottom part 20 of the perforated injection disk 21.

The metering of the gas for the improved treatment of the fuel emerging from the injection orifices 25 of the perforated injection disk 21 takes place via an annular gas gap 76, the axial extent of which results from the clearance between the insert body 60 and the gas bottom part 20. Since the insert body 60 and the gas containment part 48 are fixedly connected to one another, the entire treatment attachment 61 must be displaced axially, before the casing portion 64 is fixed to the valve seat carrier 1 by means of the weld seams 69, in such a way that the desired axial dimension of the annular gas gap 76 is set exactly. Only thereafter does the fastening of the treatment attachment 61 to the valve seat carrier 1 take place.

The axial dimension of the extent of the annular gas gap 76 forms the metering cross section for the gas, for example treatment air, flowing in from the annular duct 74. The annular gas gap 76 serves for supplying the gas to the fuel discharged through the injection orifices 25 of the perforated injection disk 21 and for metering the gas. The gas supplied through the gas inlet ducts 70, the flow duct 73 and the annular duct 74 flows through the narrow annular gas gap 76 to a mixture injection orifice 78, provided in the insert body 60 centrally and concentrically to the valve longitudinal axis 2, and there strikes the fuel discharged through the, for example, two or four injection orifices 25. As a result of the small axial extent of the annular gas gap 76, the supplied gas is sharply accelerated and atomizes the fuel particularly finely. The gas used can be, for example, the suction air branched off by a bypass upstream of a throttle flap in the suction pipe of the internal combustion engine, air conveyed by an additional blower, or alternatively recirculated exhaust gas-of the internal combustion engine or a mixture of air and exhaust gas.

The mixture injection orifice 78 in that part of the insert body 60 facing the bottom part 20 has such a large diameter that the fuel, which emerges upstream from the injection orifices 25 of the perforated injection disk 21 and which the gas, coming vertically out of the annular gas gap 76, strikes for the purpose of better treatment, can emerge unimpeded through the mixture injection orifice 78. The insert body 60 is designed in such a way that, inside it, the mixture injection orifice 78 has adjoining it an orifice 79 which is, for example, elliptic or circular in cross section and widens conically in the axial downstream direction and which has a larger orifice width than the mixture injection orifice 78. This orifice 79 in the insert body 60 is intersected transversely by a pin-like jet divider 80 possessing, for example, a circular cross section, the jet divider 80 being arranged nearer to a downstream end face 81 of the insert body 60 than to the mixture injection orifice 78. The jet divider 80 extends transversely through the valve longitudinal axis 2 and symmetrically divides an injection space 82, formed by the orifice 79, downstream of the mixture injection orifice 78. The injection space 82 is made elliptic and conical to correspond to the orifice 79. It is possible both for the jet divider 80, as a web, to be part of the insert body 60 made from plastic or to be installed additionally, for example as a pin made from another material. At all events, the jet divider 80 has an upper convex divider face 85 directed upstream.

Two or four fuel jets are generated by the two or four injection orifices 25 in the perforated injection disk 21 and, distributed over zones formed on both sides of the jet divider 80, are injected into the injection space 82. The convex design of the jet divider 80 is particularly expedient when fuel jets run past the jet divider 80 directionally or when they move away from one another at an increasing distance from the injection orifices 25. The fuel jets are struck perpendicularly by the gas flowing out of the annular gas gap 76 immediately after the fuel jets emerge from the injection orifices 25. The result of this is that the two-jet nature of the fuel jets is put at risk by the gas containment and even a unification of the two fuel jets can occur, since the gas moves the fuel jets towards one another. In contrast to wedge-shaped or knife-shaped jet dividers, in the case of the jet dividers 80 having a convex divider face 85, gas is built up above the divider face 85, the fuel jets being forced outwards apart from one another again by the stagnation pressure of the gas and therefore a distinct two-jet nature being preserved.

The convex jet divider 80 acts as flow resistance, thereby inducing a stagnation flow. The stagnation flow is responsible for the very compact jet division in the region of the jet divider 80 and for the good treatment effect of the gas containment as a result of an improved intermixing of gas and fuel. The convex divider face 85 of the jet divider 80 ensures that, despite the gas containment, an equally good two-jet nature in comparison with an arrangement without gas containment is afforded in the axial direction downstream from the jet divider 80.

Downstream of the bottom portion 63, the insert body 60 is provided, for example, with a cylindrical outer contour. A sealing ring 87, for example designed in the form of a quad ring, ensures sealing off between the gas containment body 41 and the insert body 60 exactly between the outer contour of the insert body 60 and the inner wall of the portion 45 of the gas containment body 41. The sealing ring 87 extends, for example, at the same axial height as the sealing ring 56, so that the two sealing rings extend in a manner nested one in the other, but of course separated by the gas containment body 41. The shoulder 53 extending radially outwards at the downstream end of the gas containment body 41 also has a step 88 which projects in the direction of the valve longitudinal axis 2 and which ensures that an annular chamber 90 for the sealing ring 87 is provided between the gas containment body 41 and the treatment attachment 61.

Figure 2:
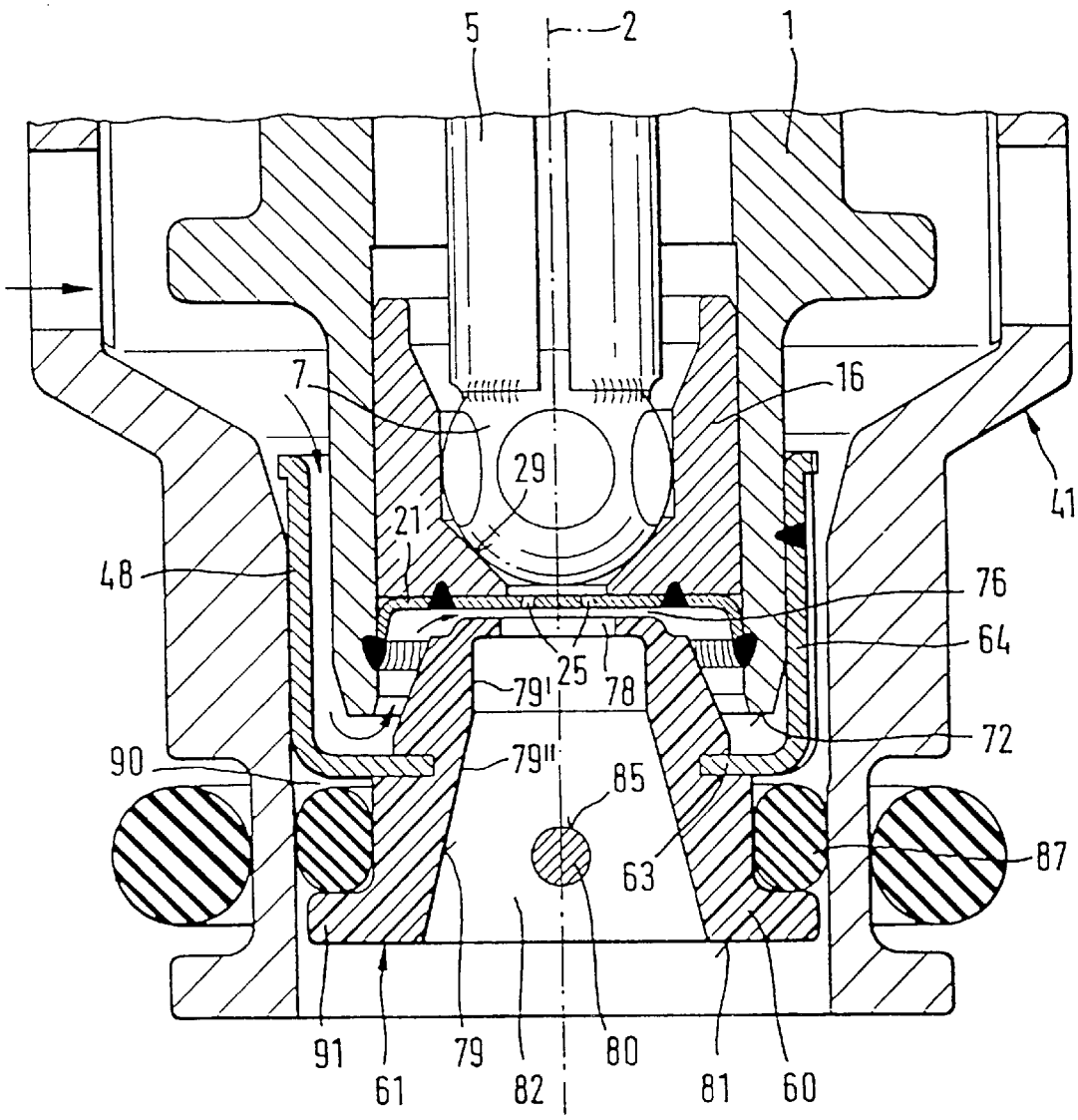
FIG. 2 shows a partially represented device for the injection of a fuel/gas mixture in a second exemplary embodiment according to the present invention.

The exemplary embodiment shown in FIG. 2 differs from the exemplary embodiment shown in FIG. 1 only in the design of the insert body 60 and of the sealing ring 87. The orifice 79 inside the insert body 60 is in this case subdivided into two portions. The mixture injection orifice 78 has directly adjoining it downstream a circular or elliptic orifice portion 79' of larger cross section, the wall of which extends parallel to the valve longitudinal axis 2. This first orifice portion 79' merges, for example only at the height of the lower end face 72 of the valve seat carrier 1, into a conical orifice portion 79" widening downstream. Only then is the jet divider 80 arranged in the second orifice portion 79". The insert body 60 also differs in the outer contour from the example shown in FIG. 1. However, the outer contour conical upstream of the bottom portion 63 also merges downstream of the bottom portion 63 for the first time into a cylindrical outer contour which therefore has a wall extending parallel to the valve longitudinal axis 2. Nevertheless, there is then provided, at the end facing away from the perforated injection disk 21, a shoulder 91 which extends radially outwards and which reaches almost as far as the inner wall of the portion 45 of the gas containment body 41. This shoulder 91 is already sufficient for receiving the sealing ring 87 designed, for example, as an O-ring, since the annular chamber 90 is formed between the bottom portion 63 and the shoulder 91. The step 88 on the gas containment body 41 can therefore be dispensed with. The inner wall of the portion 45 of the gas containment body 41 thus extends continuously in the vertical direction. In both exemplary embodiments, the insert body 60 terminates with its lower end face 81 upstream of the actual downstream termination of the gas containment body 41.

Figure 3:
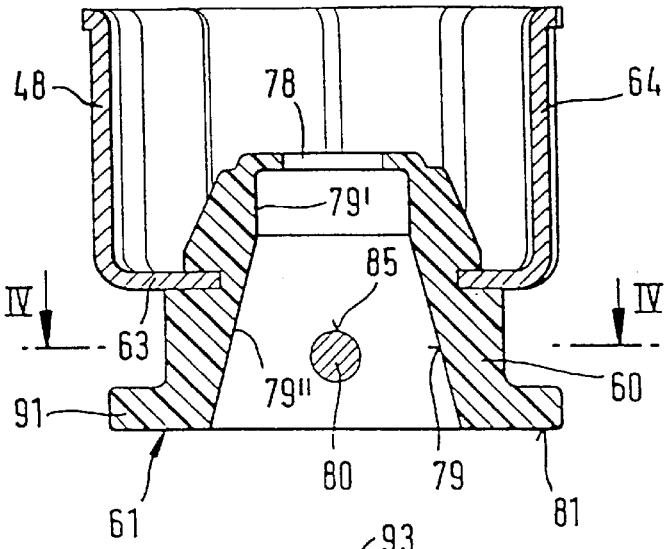
FIG. 3 shows a first example of a treatment attachment according to the present invention.
Figure 4:
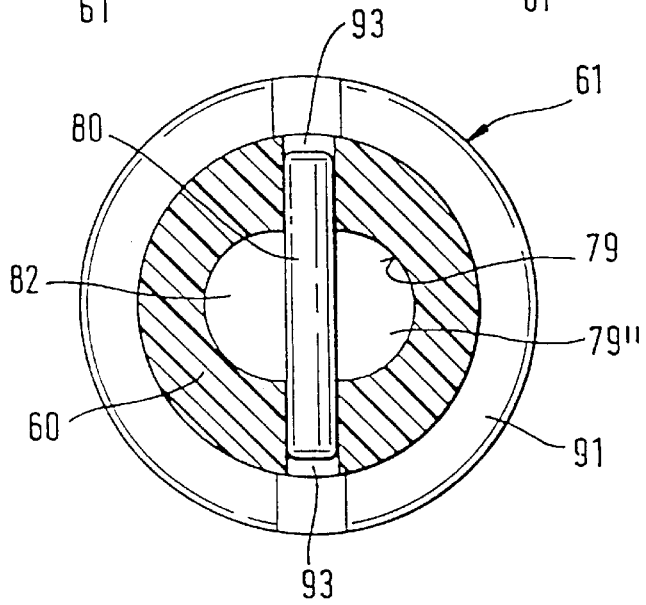
FIG. 4 shows a section along the line IV—IV in FIG. 3.

In FIG. 3, the treatment attachment 61 known from FIG. 2 is represented once again as a separate component. In this form of the design of the orifice 79 and of the arrangement of the jet divider 80, the treatment attachment 61 is particularly suitable for use in gas-contained two-jet valves. FIG. 4 is a sectional representation along the line IV—IV in FIG. 3. In this, one possibility for fastening the jet divider 80 in the insert body 60 becomes clear. So that the pin-shaped jet divider 80 can be introduced in the insert body 60, it is necessary to provide, at two points located exactly opposite one another in the insert body 60, radially extending bores 93, into which the jet divider 80 projects at each end. Advantageously, the two bores 93 are designed in such a way that, on the one hand, there is a clearance fit (assembly side) for the jet divider 80, while the other bore 93 forms a press fit (opposite side) with the jet divider 80. The press fit guarantees a sufficient fixing of the jet divider 80. In FIG. 4, moreover, the elliptic cross section of the injection space 82 becomes evident. In addition to pressing in the jet divider 80, other fastening possibilities are also appropriate, such as, for example, catch connections or thermal deformation of the insert body 60 in the region of a groove after the insertion of the jet divider 80 into this groove.

Figure 5:
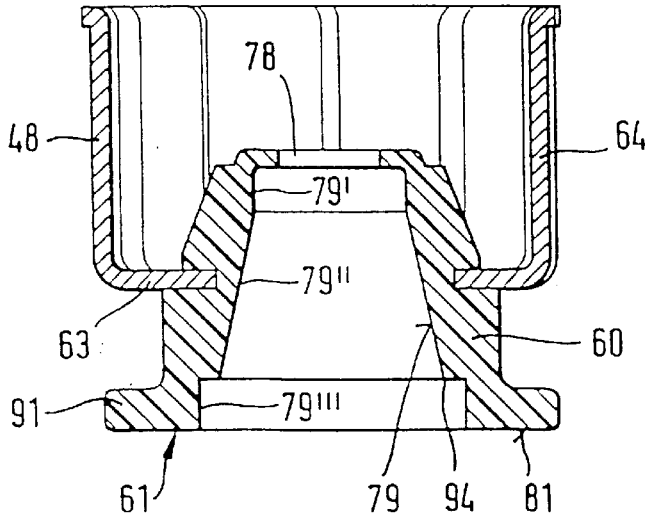
FIG. 5 shows a second example of a treatment attachment according to the present invention.

In contrast to FIG. 3, FIG. 5 shows an exemplary embodiment of a treatment attachment 61 which is particularly suitable for use on conical-jet valves. A jet divider 80 is dispensed with in this case, since a two-jet nature is not desired. Moreover, the orifice 79 is in this case subdivided into three portions, the conical orifice portion 7" once again having adjoining it an orifice portion 79'" designed with a wall parallel to the valve longitudinal axis 2. The orifice portion 79'" is made approximately in the region of axial extension of the shoulder 91 and has a substantially larger orifice width than the orifice portion 79'. The transition from the orifice portion 79" to the orifice portion 79'" is in the form of a step, so that a breakaway edge 94 for the fuel is obtained.

The bowl-shaped gas containment part 48 is represented once again as an individual part in FIG. 6. A central orifice region 95 now becomes evident in the bottom portion 63, the orifice region being necessary so that the plastic of the insert body 60 can be at least partially injection-molded around the bottom portion 63. Finally, in the installed state, the inner orifice 79 of the insert body 60 extends through the orifice region 95 of the gas containment part 48. The section taken along the line VII—VII in FIG. 6 results in a view, such as is shown in FIG. 7. The already mentioned regions 66 of larger diameter and regions 67 of smaller diameter form the casing portion 64 in a continuously alternating sequence over the circumference. It is particularly expedient in each case to form five regions 66 and 67 in the circumferential direction. The difference between the two different diameters of the regions 66 and 67 results from the radial clearance between the valve seat carrier 1 and gas containment body 41 in the region of its portion 45. This radial clearance minus the amount of the wall thickness of the casing portion 64 leads to the radial size of the interspace 50 or of the gas inlet ducts 70 and therefore to the differential amount of the diameters of the regions 66 and 67.

The central orifice region 95 in the bottom portion 63 is not made completely circular, but has orifice tips 96 which protrude somewhat radially and which are formed in a number corresponding to the regions 66 and 67, that is to say, for example, five. The orifice tips 96 are distributed over the circumference of the orifice region 95 in such a way that they always face the regions 67 of smaller diameter of the casing portion 64. This geometry of the orifice region 95 is particularly advantageous for making a positive connection between the gas containment part 48 and the surrounding injection molding (insert body 60).

Figure 8:
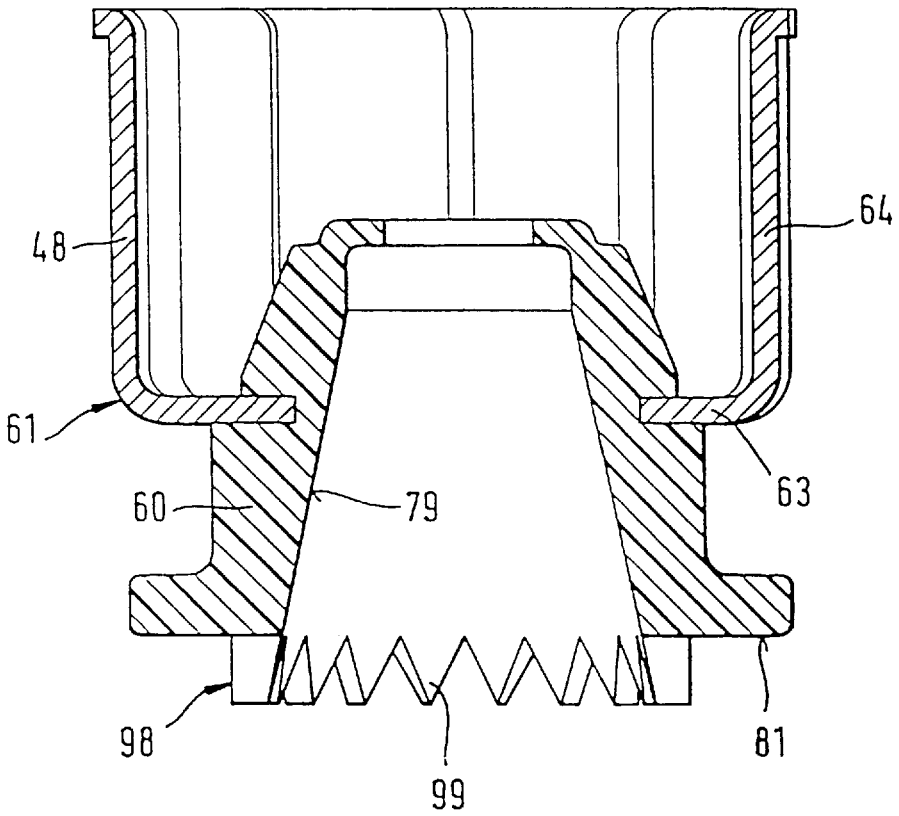
FIG. 8 shows a third example of a treatment attachment according to the present invention.

The exemplary embodiment shown in FIG. 8 is distinguished by a particular drip geometry at the downstream end of the treatment attachment 61. A drip crown 98 adjoining the lower end face 81 downstream and having a multiplicity of serrations 99 ensures an improved drip behavior of the fuel (particularly during operation without gas), since the fuel cannot converge to form large drops. The serrations 99 are designed, for example, in the form of triangular teeth which taper in the downstream direction, whereas the free regions occurring between the serrations 99 are inversely triangular, that is to say become wider in the downstream direction. The inside diameter of the drip crown 98 adjoins the conical orifice 79 in the insert body 60 seamlessly with respect to the orifice width.

What is claimed is:

1. An injection valve for injecting a fuel/gas mixture, the valve having a longitudinal axis and a downstream end, the valve comprising:

a movable valve closing body;

a valve seat body being arranged at the downstream end of the valve and having a valve seat face cooperating with the valve closing body, at least one injection orifice being arranged downstream of the valve seat face; and a multipart treatment attachment arranged at the downstream end of the valve, the attachment including a gas containment part, which includes a metal, and an insert body, which includes a plastic, the insert body extending downstream of the injection orifice and having a mixture injection orifice, the fuel/gas mixture being injected through the mixture injection orifice, the insert body further having an additional orifice, the additional orifice being inside the insert body, adjoining the mixture injection orifice, and widening at least partially in a downstream direction, the gas containment part being fixedly connected to the insert body and to the downstream end of the valve;

wherein the gas containment part is bowl-shaped, and the insert body is at least partially conical-shaped.

2. The valve according to claim 1, wherein the injection valve is an electromagnetically actuable fuel injection valve for a fuel injection system of an internal combustion engine.

3. The valve according to claim 1, wherein the gas containment part includes a casing portion and a bottom portion, the bottom portion including an orifice region, the insert body at least partially extending through the orifice region.

4. The valve according to claim 1, wherein the additional orifice predetermines an injection space, a jet divider extending transversely through the injection space to the longitudinal axis.

5. The valve according to claim 4, wherein the jet divider has a convex divider face facing the injection orifice.

6. The valve according to claim 1, further comprising a drip crown having a plurality of serrations at a downstream end of the attachment.

7. The valve according to claim 1, further comprising a gas containment body surrounding the downstream end of the valve and the attachment in an axial direction.

8. The valve according to claim 1, further comprising a perforated injection disk arranged downstream of the valve seat face, the injection disk containing the injection orifice.

9. The valve according to claim 1, wherein the additional orifice includes a first orifice portion and a second orifice portion, the first orifice portion axially adjoining the second orifice portion.

10. The valve according to claim 9, wherein the first orifice portion adjoins the second orifice portion to form a step, the step providing a break-away edge.

11. An injection valve for injecting a fuel/gas mixture, the valve having a longitudinal axis and a downstream end, the valve comprising:

a movable valve closing body;

a valve seat body being arranged at the downstream end of the valve and having a valve seat face cooperating with the valve closing body, at least one injection orifice being arranged downstream of the valve seat face; and a multipart treatment attachment arranged at the downstream end of the valve, the attachment including a gas containment part, which includes a metal, and an insert body, which includes a plastic, the insert body extending downstream of the injection orifice and having a mixture injection orifice, the fuel/gas mixture being injected through the mixture injection orifice, the insert body further having an additional orifice, the additional orifice being inside the insert body, adjoining the mixture injection orifice, and widening at least partially in a downstream direction, the gas containment part being fixedly connected to the insert body and to the downstream end of the valve;

wherein the gas containment part includes a bottom portion, and the insert body has injection-molded material at least partially around the bottom portion of the gas containment part, so as to fixedly connect the gas containment part to the insert body.

12. The valve according to claim 11, wherein the injection valve is an electromagnetically actuable fuel injection valve for a fuel injection system of an internal combustion engine.

13. The valve according to claim 11, wherein the additional orifice predetermines an injection space, a jet divider extending transversely through the injection space to the longitudinal axis.

14. The valve according to claim 13, wherein the jet divider has a convex divider face facing the injection orifice.

15. The valve according to claim 11, further comprising a drip crown having a plurality of serrations at a downstream end of the attachment.

16. The valve according to claim 11, further comprising a gas containment body surrounding the downstream end of the valve and the attachment in an axial direction.

17. The valve according to claim 11, further comprising a perforated injection disk arranged downstream of the valve seat face, the injection disk containing the injection orifice.

18. The valve according to claim 11, wherein the additional orifice includes a first orifice portion and a second orifice portion, the first orifice portion axially adjoining the second orifice portion.

19. The valve according to claim 18, wherein the first orifice portion adjoins the second orifice portion to form a step, the step providing a break-away edge.

20. An injection valve for injecting a fuel/gas mixture, the valve having a longitudinal axis and a downstream end, the valve comprising:

a movable valve closing body;

a valve seat body being arranged at the downstream end of the valve and having a valve seat face cooperating with the valve closing body, at least one injection orifice being arranged downstream of the valve seat face; and a multipart treatment attachment arranged at the downstream end of the valve, the attachment including a gas containment part, which includes a metal, and an insert body, which includes a plastic, the insert body extending downstream of the injection orifice and having a mixture injection orifice, the fuel/gas mixture being injected through the mixture injection orifice, the insert body further having an additional orifice, the additional orifice being inside the insert body, adjoining the mixture injection orifice, and widening at least partially in a downstream direction, the gas containment part being fixedly connected to the insert body and to the downstream end of the valve;

wherein the gas containment part includes a casing portion, and the casing portion includes first regions of a first diameter and second regions of a second diameter alternating in a circumferential direction.

21. The valve according to claim 20, wherein the injection valve is an electromagnetically actuable fuel injection valve for a fuel injection system of an internal combustion engine.

22. The valve according to claim 20, wherein the additional orifice predetermines an injection space, a jet divider extending transversely through the injection space to the longitudinal axis.

23. The valve according to claim 22, wherein the jet divider has a convex divider face facing the injection orifice.

24. The valve according to claim 20, further comprising a drip crown having a plurality of serrations at a downstream end of the attachment.

25. The valve according to claim 20, further comprising a gas containment body surrounding the downstream end of the valve and the attachment in an axial direction.

26. The valve according to claim 20, further comprising a perforated injection disk arranged downstream of the valve seat face, the injection disk containing the injection orifice.

27. The valve according to claim 20, wherein the additional orifice includes a first orifice portion and a second orifice portion, the first orifice portion axially adjoining the second orifice portion.

28. The valve according to claim 27, wherein the first orifice portion adjoins the second orifice portion to form a step, the step providing a break-away edge.

* * * * *